US008974186B2

(12) United States Patent
Raible

(10) Patent No.: US 8,974,186 B2
(45) Date of Patent: Mar. 10, 2015

(54) COUPLING ELEMENT SEGMENTS FOR A ROTOR OF A TURBOMACHINE

(75) Inventor: Tilmann Raible, Oberhausen (DE)

(73) Assignee: MAN Diesel & Turbo SE, Augsburg (DE)

( * ) Notice: Subject to any disclaimer, the term of this patent is extended or adjusted under 35 U.S.C. 154(b) by 744 days.

(21) Appl. No.: 13/180,363

(22) Filed: Jul. 11, 2011

(65) Prior Publication Data

US 2012/0009067 A1 Jan. 12, 2012

(30) Foreign Application Priority Data

Jul. 12, 2010 (DE) ..... 10 2010 031 213

(51) Int. Cl.
*F01D 5/22* (2006.01)

(52) U.S. Cl.
CPC ..... *F01D 5/225* (2013.01)
USPC ..... 416/191

(58) Field of Classification Search
CPC ..... F01D 5/22; F01D 5/225; F01D 5/24; F01D 5/3007; F01D 5/143; F05B 2240/80
USPC ..... 416/190, 191, 192, 193 A, 194, 195, 416/196 R, 219 R, 220 R
See application file for complete search history.

(56) References Cited

U.S. PATENT DOCUMENTS 3,185,441 A 5/1965 Reuter
3,923,420 A * 12/1975 Chifos ..... 416/190
4,400,915 A 8/1983 Arrigoni
5,001,830 A * 3/1991 Partington et al. ..... 29/889.21
5,154,581 A 10/1992 Borufka et al.
6,431,836 B2 8/2002 Zimmermann
7,819,630 B2 * 10/2010 Nogami et al. ..... 416/219 R
2004/0067131 A1 4/2004 Joslin
2006/0177314 A1 8/2006 Yamashita et al.

FOREIGN PATENT DOCUMENTS

CH 398644 3/1966
CN 101617102 12/2009

(Continued)

OTHER PUBLICATIONS

Office Action dated Aug. 8, 2013 issued in the corresponding Chinese Patent Application No. 201110193939.0.

*Primary Examiner* — Nathaniel Wiehe
*Assistant Examiner* — Kayla McCaffrey
(74) *Attorney, Agent, or Firm* — Cozen O'Connor

(57) ABSTRACT

A rotor of a turbomachine has a rotor base body and a plurality of rotor blades. Every rotor blade has a blade body and a coupling element segment. The coupling element segment of every rotor blade is contoured at a first side and at a second side opposite the first side that, at the first side and at the second side, a radially outer edge of the respective coupling element segment extends substantially in axial direction and a radially inner edge of the respective coupling element segment extends substantially in axial direction respectively delimit two surfaces separated from one another by a separating line. In at least one circumferential position of the rotor between two directly adjacent rotor blades, the separating lines run approximately parallel to, or in alignment with, the mounting direction of the rotor blades at the rotor base body, which mounting direction is defined by the blade roots. In every other circumferential position between two directly adjacent rotor blades, the separating lines formed at directly adjacent sides of the coupling element segments are oblique relative to the mounting direction.

16 Claims, 3 Drawing Sheets

(56) References Cited

FOREIGN PATENT DOCUMENTS

| | | |
|---|---|---|
| DE | 1122551 | 1/1962 |
| DE | 1159965 | 12/1963 |
| DE | 4015206 | 10/1991 |
| DE | 10 2009 029 587 | 3/2011 |
| EP | 1134359 | 9/2001 |
| GB | 2072760 | 10/1981 |
| JP | 09-209703 | 8/1997 |
| JP | 2006-083761 | 3/2006 |

* cited by examiner

COUPLING ELEMENT SEGMENTS FOR A ROTOR OF A TURBOMACHINE

BACKGROUND OF THE INVENTION

1. Field of the Invention

The invention is directed to a rotor of a turbomachine.

2. Description of the Related Art

A rotor of a turbomachine, particularly of a gas turbine or steam turbine, has a rotor base body and a plurality of rotor blades that are fastened to the rotor base body. The rotor blades of the turbomachine rotor have a blade root and a blade body. Every rotor blade is fastened by its blade root to the rotor base body in a slot of the rotor base body in a mounting direction defined by the blade roots, and every rotor blade has in the region of its blade body at least one coupling element segment constructed as an outer shroud segment when this coupling element segment is positioned on the radially outer side of the blade body. The coupling element segments, particularly the outer shroud segments, of all of the rotor blades of a turbomachine rotor of this kind together form at least one circumferentially closed coupling element of the rotor, particularly an outer shroud.

Considered in circumferential direction of a turbomachine rotor, a width of a coupling element segment, particularly an outer shroud segment, of every rotor blade is defined by edges extending substantially in axial direction. A depth in axial direction of the coupling element segment, particularly of the outer shroud segment, of every rotor blade is defined by edges extending substantially in circumferential direction. Aside from the width in circumferential direction and the depth in axial direction, a coupling element segment, particularly an outer shroud segment, of every rotor blade is also characterized by a thickness in radial direction.

Turbomachine rotors whose rotor blades have coupling element segments of the type mentioned above for forming at least one coupling element can be installed in the region of the compressor as well as in the region of a turbine of the turbomachine.

Turbomachine rotors having rotor blades are fastened to their rotor base body and have at the radially outer side of the blade body a coupling element segment formed as an outer shroud segment are known, for example, from DE 1 159 965 C, DE 40 15 206 C1, U.S. Pat. No. 4,400,915 A, and GB 2 072 760 A. It is known from EP 1 134 359 A1 and DE 1 122 551 C to fasten the rotor blades by the blade roots to the rotor base body in a slot of the rotor base body in a mounting direction defined by the blade roots. The blade roots can have a fir-tree contour, a hammerhead contour, or a contour of another kind. A separate slot can be provided at the rotor base body for each blade root. Further, it is possible for all of the blade roots to be fastened in a common slot and to be threaded into this common slot through an insertion opening and, in this way, mounted at the rotor base body.

The coupling elements of turbomachine rotors of the type mentioned above formed as outer shroud segments are exposed to high loads in operation because they rotate at maximum radius with respect to an axis of rotation of the turbomachine rotor and are therefore exposed to high centrifugal forces. As a result of the centrifugal load, corners and edges of the coupling element segments of the rotor blades bend outward so that on the one hand stress peaks are caused in the coupling element and on the other hand a desired contact between adjacent coupling element segments of adjacent rotor blades is reduced to punctiform contact or disappears entirely. This reduces or eliminates a desired coupling between adjacent coupling element segments so that the vibration behavior of the turbomachine rotor eventually deteriorates.

SUMMARY OF THE INVENTION

An object of one embodiment of the present invention is to provide a rotor of a turbomachine in which coupling of the coupling element segments of the rotor blades is ensured during operation and the rotor is easily mounted.

According to one embodiment of the invention, the coupling element segment of every rotor blade is contoured in such a way at a first side to which a coupling element segment of a first directly adjacent rotor blade is connected considered in circumferential direction and at a second side which is located opposite the first side and to which a coupling element segment of a second directly adjacent rotor blade is connected considered in circumferential direction that, at the first side and at the second side, a radially outer edge of the respective coupling element segment extending substantially in axial direction and a radially inner edge of the respective coupling element segment extending substantially in axial direction respectively delimit two surfaces separated from one another by a separating line, wherein, in at least one circumferential position of the rotor between two directly adjacent rotor blades, the separating lines of these directly adjacent rotor blades formed at directly adjacent sides of the coupling element segments run approximately parallel to, or in alignment with, the mounting direction of the rotor blades at the rotor base body, which mounting direction is defined by the blade roots, whereas in every other circumferential position between two directly adjacent rotor blades, the separating lines of these directly adjacent rotor blades formed at directly adjacent sides of the coupling element segments are oblique relative to the mounting direction of the rotor blades at the rotor base body.

With the inventive rotor of a turbomachine, an optimal support and, therefore, an optimal coupling of the coupling element segments forming the coupling element or every coupling element is ensured by the contour of the coupling element segments of the rotor blades and the rotor is easily mounted. In this way, stress peaks in the coupling element of the rotor, or in every coupling element of the rotor, can be appreciably reduced in operation and the rotor can be mounted easily. Further, the resonant frequency behavior and, therefore, the vibration behavior of the rotor according to the invention are improved and the rotor can be mounted easily.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Embodiment examples of the invention will be described in more detail with reference to the drawings without the invention being limited to these embodiment examples. In the drawings.

DETAILED DESCRIPTION OF THE PRESENTLY PREFERRED EMBODIMENTS

The present invention is directed to a rotor of a turbomachine, particularly a rotor of a compressor or of a turbine of a turbomachine constructed as a gas turbine or steam turbine. However, the invention is not limited to these applications; rather, the invention can be put to use in all turbomachine rotors.

A rotor of a turbomachine basically has a rotor base body and a plurality of rotor blades fastened by blade roots to the rotor base body. The rotor base body and the blade roots of rotor blades are not shown in detail in FIGS. 1 to 5 because those skilled in the art will be familiar with these details. However, it should be noted in this connection that every rotor blade is fastened by its blade root to the rotor base body in a slot of the rotor base body in a mounting direction defined by the blade roots. For this purpose, a separate slot can be provided at the rotor base body for every rotor blade or blade root of every rotor blade. Further, it is possible for all of the rotor blades to be fastened by their blade roots in a common slot and threaded into this common slot through an insertion opening and, in this way, mounted at the rotor base body.

Figure 1:
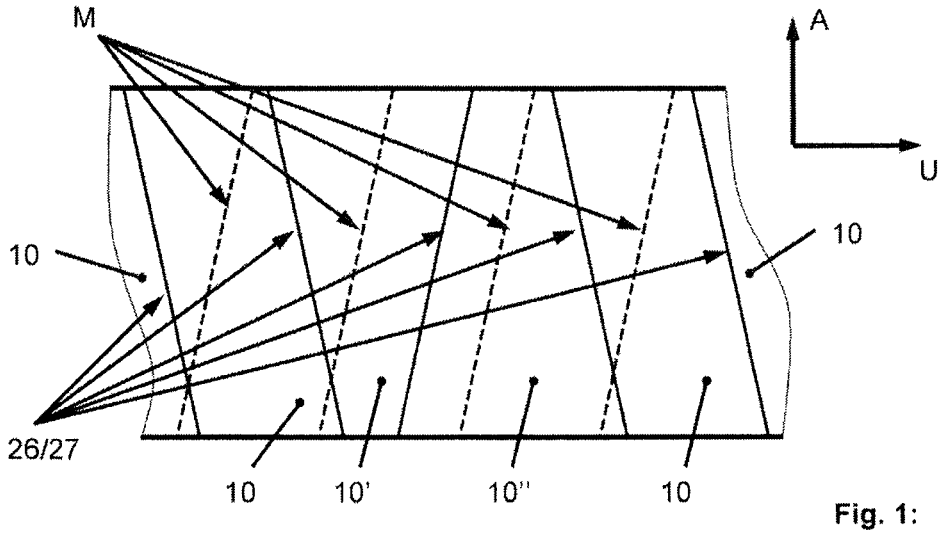
FIG. 1 is a schematic sectional top view of a coupling element, constructed as an outer shroud, of a rotor of a turbomachine viewed from the radially outer side according to one embodiment of the invention.
Figure 2:
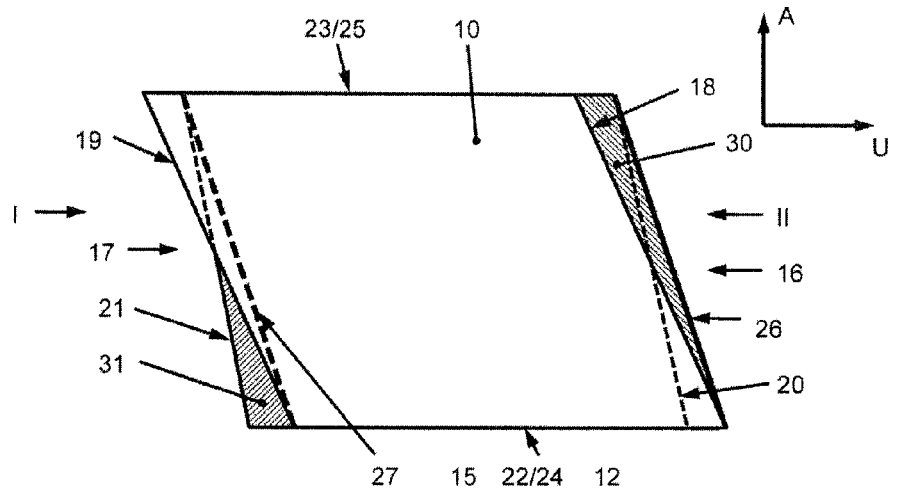
FIG. 2 is a schematic top view of a rotor blade of the rotor in FIG. 1, namely, of a coupling element segment of the rotor blade of the rotor in FIG. 1, which coupling element segment is formed as an outer shroud segment, viewed from the radially outer side.
Figure 3:
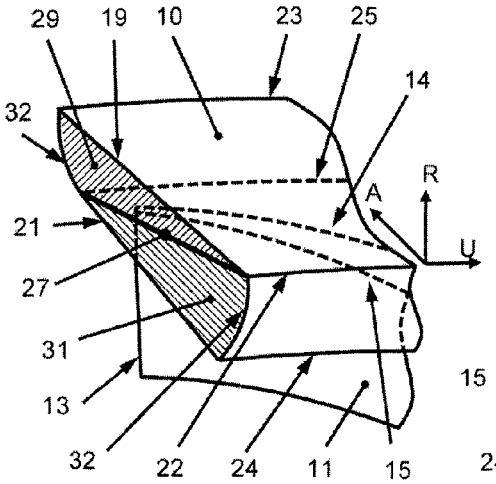
FIG. 3 is a perspective section from the rotor blade of FIG. 2 viewed in circumferential direction I of FIG. 2.
Figure 4:
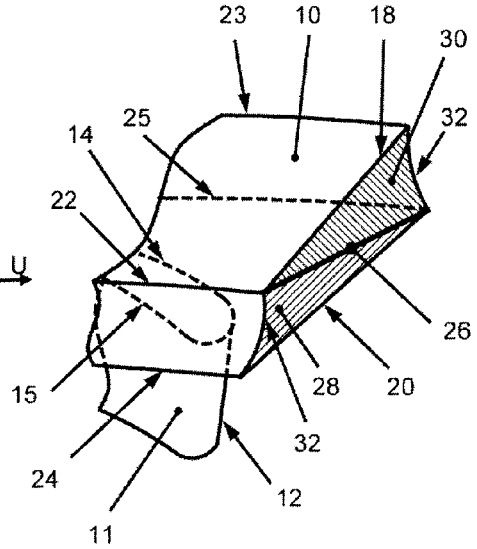
FIG. 4 is another perspective section from the rotor blade of FIG. 2 viewed in circumferential direction II of FIG. 2.
Figure 5:
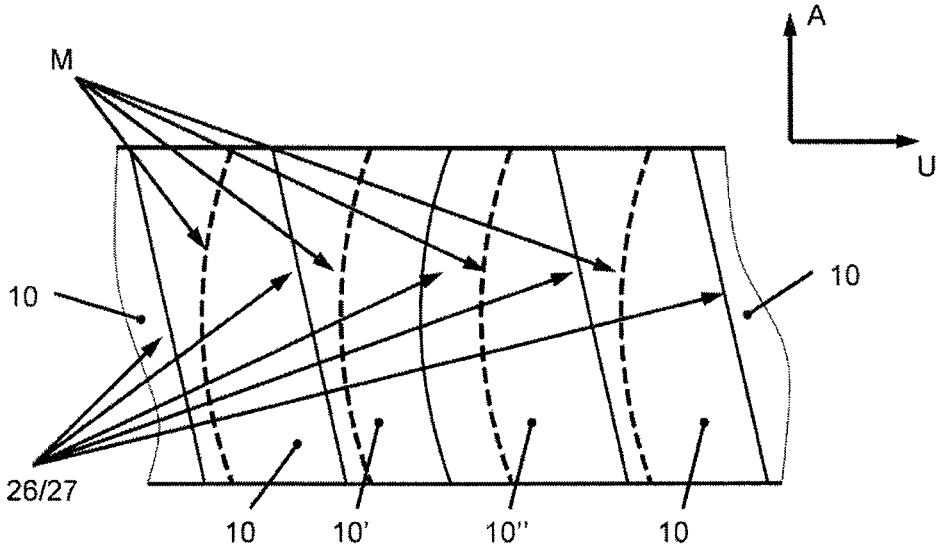
FIG. 5 is a schematic sectional top view of a coupling element, constructed as an outer shroud, of a rotor according to the invention of a turbomachine viewed from the radially outer side.

The mounting direction M of the rotor blades at the rotor base body defined by the blade roots is shown schematically by dashed lines in FIGS. 1 and 5. In FIGS. 1 and 5, a separate slot is provided at the rotor base body for the blade root of every rotor blade. In FIG. 1, the mounting direction M extends in a straight line, and in FIG. 5 the mounting direction M extends in a curved line. In both cases, viewed in axial direction A of the rotor, the mounting direction M of the rotor blades inclines in a first orientation in circumferential direction U relative to axial direction A. The mounting direction M and the axial direction A enclose a rhomboid angle which changes in axial direction A when the mounting direction M is curved. Aside from axial direction A and circumferential direction U of the rotor, a radial direction R is also shown.

FIGS. 1 to 4 show different detailed views of a rotor according to one embodiment of the invention of a turbomachine. FIG. 1 shows a section from a coupling element formed as an outer shroud which comprises coupling element segments 10, 10', 10" of a plurality of rotor blades, these coupling element segments 10, 10', 10" being constructed as outer shroud segments. As can be seen most clearly from FIGS. 3 and 4, the outer shroud segments 10, 10', 10" are associated with a radially outer end of a blade body 11 of the respective rotor blade. The blade body 11 has a flow inlet edge 12, a flow outlet edge 13, a suction side 14, and pressure side 15 extending between the flow inlet edge 12 and the flow outlet edge 13.

The outer shroud segment 10, 10', 10" associated with the blade body 11 of every rotor blade on the radially outer side has a width in circumferential direction U which is defined by edges extending substantially in axial direction A. Accordingly, a radially outer edge 18 and 19, respectively, extending substantially in axial direction A and a radially inner edge 20 and 21, respectively, which likewise extends substantially in axial direction A extend, respectively, at two opposite sides 16 and 17 of the outer shroud segment 10, 10', 10". The distance between this radially outer edge 18 and 19, respectively, and this radially inner edge 20 and 21, respectively, determines the thickness of the outer shroud segment 10, 10', 10" at sides 16 and 17 in radial direction R.

A depth in axial direction A of the outer shroud segment 10, 10', 10" of every rotor blade is defined by edges extending substantially in circumferential direction U, namely, again, by radially outer edges 22 and 23, respectively, and radially inner edges 24 and 25, respectively. Edges 22 and 24 are edges on the flow inlet side, and edges 23 and 25 are edges on the flow outlet side. Also, the distance between these edges determines the thickness of the outer shroud segment 10, 10', 10" in radial direction R, namely, on the flow inlet side and flow outlet side.

Viewed from the radially outer side, the contour of the outer shroud segment 10, 10', 10" of every rotor blade is carried out in such a way in the region of a first side 16 at which an outer shroud segment of a first directly adjacent rotor blade adjoins a second side thereof in circumferential direction U that, adjacent on the flow inlet side to the flow inlet edge 12 of the blade body 11 of each respective rotor blade, the radially outer edge 18 of the outer shroud segment 10, 10', 10" extending essentially in axial direction A projects out in circumferential direction U relative to the radially inner edge 20 of the outer shroud segment 10, 10', 10" extending substantially in axial direction A.

At this first side 16 facing the flow outlet edge 13 on the flow outlet side, the radially inner edge 20 of the outer shroud segment 10, 10', 10" extending substantially in axial direction A projects out in circumferential direction U relative to the radially outer edge 18 which likewise extends substantially in axial direction A.

At the opposite, second side 17 of the outer shroud segment 10, 10', 10" to which a directly adjacent second rotor blade is connected with its outer shroud segment, namely with a first side thereof, the contour of this outer shroud segment is carried out such that, adjacent on the flow outlet side to the flow outlet edge 13 of the blade body 11, the radially outer edge 19 of the outer shroud segment 10, 10', 10" extending essentially in axial direction A projects out in circumferential direction U relative to the radially inner edge 21 which likewise extends substantially in axial direction A.

At this second side 17 remote of the flow inlet edge 12 on the flow inlet side, the radially inner edge 21 of the outer shroud segment 10, 10', 10", extending substantially in axial direction A, projects out in circumferential direction U relative to the radially outer edge 19 which likewise extends substantially in axial direction A.

At the first side 16 of the outer shroud segment 10, 10', 10" that faces toward the flow inlet edge 12 of the blade body 11 and faces away from the flow outlet edge 13 of the same, and at the second side 17 of the outer shroud segment 10, 10', 10" that faces toward the flow inlet edge 13 of the blade body 11 and faces away from the flow inlet edge 12, the radially outer edges 18 and 19, respectively, which extend substantially in axial direction A, together with the radially inner edges 20 and 21, respectively, which likewise extend substantially in axial direction A, respectively delimit two surfaces separated from one another by a separating line 26 and 27, respectively, namely, a surface 28 and 29, respectively, which is concealed considered from the radially outer side and a surface 30 and 31, which is visible viewed from the radially outer side.

At the first side 16 of the outer shroud segment 10, 10', 10", the surface 28 is concealed from the radially outer side is positioned on the flow inlet side and the surface 30 which is visible from the radially outer side is positioned on the flow outlet side. In the region of the opposite second side 17 of the outer shroud segment 10, 10', 10", on the other hand, the surface 29, which is concealed from the radially outer side, is positioned on the flow outlet side and the surface 31 is visible from the radially outer side and is positioned on the flow inlet side.

According to one embodiment of the invention, in at least one circumferential position of the rotor between two directly adjacent rotor blades, the separating lines 26, 27 of these directly adjacent rotor blades formed at directly adjacent sides of the respective coupling element segments 10' and 10" run approximately parallel to, or in alignment, with the mounting direction M of the rotor blades at the rotor base body, which mounting direction M is defined by the blade roots, whereas, in every other circumferential position between two directly adjacent rotor blades, the separating lines 26, 27 of these directly adjacent rotor blades formed at directly adjacent sides of the respective coupling element segments 10, 10' and 10" are oblique to the mounting direction M.

As was already stated, the mounting direction M of the rotor blades at the rotor base body, viewed in axial direction A of the rotor, is inclined by the rhomboid angle relative to the axial direction A in a first orientation in circumferential direction U. At the circumferential position, or at every circumferential position, of the rotor at which the separating lines 26, 27 formed at the directly adjacent rotor blades extend approximately parallel to, or in alignment with, the mounting direction M of the rotor blades at the rotor base body defined by the blade roots, the separating lines 26, 27 are inclined in circumferential direction U relative to the axial direction A in the same first orientation as the mounting direction. On the other hand, at the circumferential position, or at every circumferential position, of the rotor between two directly adjacent rotor blades, the separating lines 26, 27 are inclined in circumferential direction relative to the axial direction in a second orientation opposite to the first orientation as the mounting direction M.

Due to the above-mentioned contours of the coupling element segments 10, 10' and 10" of the rotor blades, an optimal support and, therefore, an optimal coupling of the coupling element segments forming the coupling element, or every coupling element, is ensured while facilitating the mounting of the rotor. Accordingly, the separating lines 26 and 27, which are oblique to the mounting direction M at directly adjacent sides of the coupling element segments 10, 10' and 10", ensure an optimal support and, therefore, an optimal coupling of the coupling element segments. The separating lines 26 and 27 that extend approximately parallel to, or in alignment with, the mounting direction M at directly adjacent sides of the coupling element segments 10' and 10" facilitate the mounting of the last rotor blade to be mounted at the rotor base body in particular. It is sufficient when the separating lines 26, 27 formed at directly adjacent sides of the respective coupling element segments 10' and 10" extend approximately parallel to, or in alignment with, the mounting direction M of the rotor blades at the rotor base body at one individual circumferential position of the rotor between two directly adjacent rotor blades. But this can also be the case at a plurality of circumferential positions of the rotor for improving the vibration behavior.

Stress peaks can be appreciably reduced in the coupling element, or every coupling element, of the rotor in operation by the above-mentioned contours of the coupling element segments 10, 10' and 10" of the rotor blades, and the rotor can be mounted easily. Further, the resonant frequency behavior and, therefore, the vibration behavior of the rotor according to the invention can be improved while facilitating mounting.

The separating lines 26, 27 enclose an angle of at most about 10°, preferably at most 5°, with the mounting direction M at the circumferential position, or at every circumferential position, of the rotor at which the separating lines 26, 27 formed at the coupling element segments 10, 10' and 10" of directly adjacent rotor blades run approximately parallel to the mounting direction M of the rotor blades at the rotor base body, which mounting direction M is defined by the blade roots.

The radially outer edges 18 and 19, respectively, which extend substantially in axial direction A and the radially inner edges 20 and 21, respectively, which likewise extend substantially in axial direction A and which delimit the surfaces 28, 29, 30 and 31, respectively, together with the separating lines 26, 27 preferably also run in the same orientation as the separating lines 26, 27.

When a separating line 26 or 27 runs approximately parallel to, or in alignment with, the mounting direction M of the rotor blades, the respective edges 18, 20 and 19, 21, respectively, also run approximately parallel to, or in alignment with, the mounting direction M.

When a separating line 26 or 27 is oblique to the mounting direction M of the rotor blades, the respective edges 18, 20 and 19, 21, respectively, are also oblique to the mounting direction M, namely in the same orientation as the respective separating line 26 or 27.

The separating lines 26 and 27 which separate the surfaces 28 and 30 and surfaces 29 and 31 from one another, respectively, at the first side 16 and at the second side 17 are constructed according to a preferred further development of the invention so as to be without an inflection point, these separating lines 26 and 27 extending in a straight line in the embodiment example shown in FIGS. 1 to 4 and in a curved line in FIG. 5. This allows an especially simple manufacture. The edges 18, 19, 20 and 21 extending substantially in axial direction A are likewise constructed without an inflection point.

In the embodiment example in FIGS. 1 to 4, the separating line 26 of the first side 16 is visible viewed from the radially outer side, whereas the separating line 27 of the second side 17 is concealed considered from the radially outer side. According to FIGS. 3 and 4, the separating lines 26 and 27 of the two sides 16, 17 run from the radially outer side to the radially inner side, respectively, proceeding from edges on the flow inlet side to edges on the flow outlet side.

In the area of the first side 16 of the outer shroud segment 10 and of the opposite, second side 17 of the outer shroud segment 10, the surfaces 28 and 29, respectively, are concealed from the radially outer side and the surfaces 30 and 31, respectively, and are visible when viewed from the radially outer side are inclined by an angle relative to the radial direction R considered along the respective separating line 26 and 27. The surfaces 28 and 29, respectively, are concealed from the radially outer side are inclined relative to the radial direction R by a first angle and the surfaces 30 and 31, respectively, and are visible from the radially outer side are inclined relative to the radial direction R by a second angle. At the first side 16 and second side 17, the first angle and second angle are preferably identical with respect to degree but have different mathematical signs. This is particularly advantageous in technical respects relating to manufacture. In contrast, however, it is also possible that the first angle and the second angle at the first side 16 and second side 17 differ in degree but again have different mathematical signs.

According to one embodiment of the invention, the surfaces 28 and 29, respectively, which are concealed from the radially outer side and the surfaces 30 and 31, respectively, which are visible from the radially outer side have a surface ratio of 1:1 at the first side 16 of the outer shroud segment 10 and at the second side 17 of the outer shroud segment 10, which means that the surfaces 28 and 29, respectively, which are concealed from the radially outer side and the surfaces 30 and 31, respectively, which are visible from the radially outer side are identically dimensioned at the two sides 16 and 17. It should be noted that these surfaces can also have different dimensions at the first side 16 and at the second side 17. Accordingly, it is possible that the surfaces 28 and 29, respectively, which are concealed from the radially outer side and the surfaces 30 and 31, respectively, which are visible from the radially outer side have a surface ratio of up to 1:5 or up to 5:1, particularly a surface ratio of up to 1:3 or up to 3:1, at the first side 16 and/or at the second side 17. By deliberately increasing or decreasing the surface ratio between the surface 28 and 29, respectively, which is concealed from the radially outer side and the surface 30 and 31, respectively, which is visible from the radially outer side at sides 16 and 17, it is possible to adapt the desired coupling between the outer shroud segments 10 of adjacent rotor blades in an optimal manner. This can also be carried out by the above-mentioned angles which are enclosed by these surfaces with the respective separating line 26 and 27, respectively.

As can be seen most clearly from FIG. 1, the radially outer edges 18 and 19, respectively, which extend substantially in axial direction A and the radially inner edges 20 and 21, respectively, which extend substantially in axial direction A are congruent with one another exclusively in an axial position when viewed from the radially outer side at the first side 16 and at the second side 17 of the outer shroud segment 10.

According to FIGS. 1 to 4, the surfaces 28 and 29, respectively, and the surfaces 30 and 31, respectively, formed at the sides 16 and 17 of the outer shroud segment 10 have a three-dimensional contour and are spatially radially curved. Edges 32 which extend substantially in radial direction and which delimit the outer shroud segment 10 together with edges 18, 19, 20, 21, 22, 23, 24 and 25 are accordingly curved.

In contrast, it is also possible that these surfaces 28, 29, 30 and 31 are constructed as two-dimensionally contoured, plane surfaces. Edges 32 extend substantially in radial direction and which delimit the outer shroud segment 10 together with edges 18, 19, 20, 21, 22, 23, 24 and 25 accordingly run in a straight line.

The embodiment example from FIG. 5 differs from the embodiment example of FIGS. 1 to 4 only in that the mounting direction M of the rotor blades is curved instead of running in a straight line. The embodiment example of FIG. 5 corresponds to the embodiment example of FIGS. 1 to 4 with respect to the rest of the details, so that the above statements may be referred to in this regard.

Further modifications of the invention are possible. For example, it is possible that the radially outer edges 18 and 19 and the radially inner edges 20 and 21 extend substantially in axial direction A and define the width of the outer shroud segment 10 in circumferential direction U also have a curved contour or extend in a curved manner but without an inflection point, respectively, at the two opposite sides 16 and 17 in the same way as the separating lines 26, 27. Further, it is possible that a rotor according to the invention not only has a coupling element formed as an outer shroud segment 10 but also a coupling element formed as an inner coupling element. In this case, the outer shroud segments and inner coupling element segments are formed in the manner described above. Further, it is possible that a rotor according to the invention has no outer shroud segment but rather exclusively at least one coupling element segment formed as an inner coupling element segment. Further, it is possible that the separating line 26 of the first side 16 is concealed considered from the radially outer side, whereas the separating line 27 of the second side 17 is visible considered from the radially outer side.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A rotor of a turbomachine comprising:

a rotor base body having a plurality of slots;

a plurality of rotor blades, wherein each rotor blade comprises:

a blade root;

a blade body, fastened by its blade root to the rotor base body in a respective slot of the rotor base body in a mounting direction defined by the blade roots;

at least one coupling element segment in the region of its blade body, wherein, in circumferential direction, a width of the coupling element segment is defined by edges extending substantially in axial direction, wherein the at least one of the coupling element segment is contoured such that at a first side to which a coupling element segment of a first directly adjacent rotor blade is connected considered in circumferential direction and at a second side which is located opposite the first side and to which a coupling element segment of a second directly adjacent rotor blade is connected considered in circumferential direction that, at the first side and at the second side, a radially outer edge of the respective coupling element segment extends substantially in axial direction and a radially inner edge of the respective coupling element segment extends substantially in axial direction and respectively delimit two surfaces separated from one another by a separating line, wherein each separating line runs from the radially outer edge to the radially inner edge proceeding from edges on a flow inlet side to edges on the a flow outlet side, wherein, in at least one circumferential position of the rotor between two directly adjacent rotor blades, respective separating lines of these directly adjacent rotor blades formed at directly adjacent sides of the coupling element segments run one of approximately parallel to and in alignment with the mounting direction of the rotor blades at the rotor base body, which mounting direction is defined by the blade roots, whereby in every other circumferential position between two directly adjacent rotor blades, the separating lines of these directly adjacent rotor blades formed at directly adjacent sides of the coupling element segments are oblique relative to the mounting direction.

2. A rotor of a turbomachine comprising: a rotor base body having a plurality of slots;

a plurality of rotor blades, wherein each rotor blade comprises:

a blade root;

a blade body, fastened by its blade root to the rotor base body in a respective slot of the rotor base body in a mounting direction defined by the blade roots;

at least one coupling element segment in the region of its blade body, wherein, in circumferential direction, a width of the coupling element segment is defined by edges extending substantially in axial direction, wherein the at least one of the coupling element segment is contoured such that at a first side to which a coupling element segment of a first directly adjacent rotor blade is connected considered in circumferential direction and at a second side which is located opposite the first side and to which a coupling element segment of a second directly adjacent rotor blade is connected considered in circumferential direction that, at the first side and at the second side, a radially outer edge of the respective coupling element segment extends substantially in axial direction and a radially inner edge of the respective coupling element segment extends substantially in axial direction and respectively delimit two surfaces separated from one another by a separating line, wherein, in at least one circumferential position of the rotor between two directly adjacent rotor blades, respective separating lines of these directly adjacent rotor blades formed at directly adjacent sides of the coupling element segments run one of approximately parallel to and in alignment with the mounting direction of the rotor blades at the rotor base body, which mounting direction is defined by the blade roots, whereby in every other circumferential position between two directly adjacent rotor blades, the separating lines of these directly adjacent rotor blades formed at directly adjacent sides of the coupling element segments are oblique relative to the mounting direction, wherein the mounting direction of the rotor blades at the rotor base body viewed in axial direction is inclined relative to the axial direction in a first orientation in circumferential direction, wherein, at the circumferential position of the rotor at which the separating lines formed at the directly adjacent rotor blades extend one of approximately parallel to and in alignment with the mounting direction of the rotor blades at the rotor base body defined by the blade roots, the separating lines are inclined in circumferential direction relative to the axial direction in the same orientation as the mounting direction, whereas, at the every other circumferential position of the rotor between two directly adjacent rotor blades, the separating lines are inclined in circumferential direction relative to the axial direction in a second orientation opposite to the first orientation as the mounting direction.

3. The rotor according to claim 2, wherein the separating lines enclose an angle of at most 10° with the mounting direction at the circumferential position or at every circumferential position of the rotor at which the separating lines formed at the directly adjacent rotor blades run one of approximately parallel to and in alignment with the mounting direction of the rotor blades at the rotor base body, which mounting direction is defined by the blade roots.

4. The rotor according to claim 3, wherein the separating lines enclose an angle of at most 5° with the mounting direction at the circumferential position or at every circumferential position of the rotor at which the separating lines formed at the directly adjacent rotor blades run one of approximately parallel to and in alignment with the mounting direction of the rotor blades at the rotor base body, which mounting direction is defined by the blade roots.

5. The rotor according to claim 2, wherein, viewed from the radially outer side the coupling element segment of every rotor blade is contoured at the first side such that, adjacent on a flow inlet side to a flow inlet edge of the respective rotor blade, the radially outer edge extending substantially in axial direction projects out in circumferential direction relative to the radially inner edge extending substantially in axial direction, whereas at this first side remote of a flow outlet edge of the respective rotor blades on the flow outlet side the radially inner edge extending substantially in axial direction projects out in circumferential direction relative to the radially outer edge extending substantially in axial direction, and in that the coupling element segment of every rotor blade is contoured at the second side in such a way that, adjacent on the flow outlet side to the flow outlet edge of the respective rotor blade, the radially outer edge extending substantially in axial direction projects out in circumferential direction relative to the radially inner edge extending substantially in axial direction, whereas, at this second side remote of the flow inlet edge of the respective rotor blades on the flow inlet side, the radially inner edge extending substantially in axial direction projects out in circumferential direction relative to the radially outer edge extending substantially in axial direction.

6. The rotor according to claim 2, wherein a surface that is concealed considered from the radially outer side and a surface that is visible when viewed from the radially outer side are formed, respectively, at the first side and at the second side, wherein, at the first side, the surface that is concealed from the radially outer side is positioned on a flow inlet side and the surface which is visible from the radially outer side is positioned on a flow outlet side, and wherein, at the second side, the surface that is concealed from the radially outer side is positioned on the flow outlet side and the surface which is visible from the radially outer side is positioned on the flow inlet side.

7. The rotor according to claim 2, wherein at the first side and at the second side of the respective coupling element segment the separating lines that separate the surfaces that are concealed from the radially outer side from the surfaces that are visible from the radially outer side at the first side and at the second side are constructed without an inflection point.

8. The rotor according to claim 2, wherein, at the first side and at the second side of the respective coupling element segment viewed in direction along the separating lines, the surface that is concealed from the radially outer side is inclined relative to the radial direction by a first angle and the surface that is visible from the radially outer side is inclined relative to the radial direction by a second angle.

9. The rotor according to claim 8, wherein, at the first side and at the second side of the respective coupling element segment, the first angle and second angle are one of identical with respect to degree and have different mathematical signs and the first angle and the second angle differ in degree and have different mathematical signs.

10. The rotor according to claim 2, wherein, at the first side and at the second side of the respective coupling element segment, the surface that is concealed from the radially outer side and the surface which is visible from the radially outer side are identically dimensioned and have a surface ratio of 1:1.

11. The rotor according to claim 2, wherein, at the first side and at the second side of the respective coupling element segment the surface that is concealed from the radially outer side and the surface that is visible from the radially outer side have different dimensions and have a surface ratio of about 1:5 to about 5:1.

12. The rotor according to claim 11, wherein the surface ratio is about 1:3 to about 3:1.

13. The rotor according to claim 2 wherein, at the first side and at the second side of the respective coupling element segment the surface that is concealed from the radially outer side and the surface that is visible from the radially outer side are one of two-dimensionally contoured plane surfaces and three-dimensionally contoured spatially curved surfaces.

14. The rotor according to claim 2, wherein the radially outer edge extends substantially in the axial direction and the radially inner edge extends substantially in the axial direction are congruent at exclusively one axial overlap area at least one of the first side and at the second side of the respective coupling element segment viewed from the radially outer side.

15. The rotor according to claim 2, wherein each rotor blade has on the radially outer side in the region of its blade body a coupling element segment formed as an outer shroud segment.

16. The rotor according to claim 2, wherein each rotor blade has in the region of its blade body at least one coupling element segment formed as an inner coupling element segment.

* * * * *